US008207724B2

(12) United States Patent
Riehl

(10) Patent No.: US 8,207,724 B2
(45) Date of Patent: Jun. 26, 2012

(54) BANDGAP VOLTAGE REFERENCE WITH DYNAMIC ELEMENT MATCHING

(75) Inventor: Patrick Stanley Riehl, Cambridge, MA (US)

(73) Assignee: MediaTek Singapore Pte. Ltd., Singapore (SG)

( * ) Notice: Subject to any disclaimer, the term of this patent is extended or adjusted under 35 U.S.C. 154(b) by 415 days.

(21) Appl. No.: 12/560,440

(22) Filed: Sep. 16, 2009

(65) Prior Publication Data

US 2011/0062938 A1 Mar. 17, 2011

(51) Int. Cl.
*G05F 3/26* (2006.01)

(52) U.S. Cl. ..... 323/313

(58) Field of Classification Search ..... 323/311–317; 327/539

See application file for complete search history.

(56) References Cited

U.S. PATENT DOCUMENTS 3,887,863 A 6/1975 Brokaw
5,629,612 A * 5/1997 Schaffer ..... 323/313
5,867,012 A 2/1999 Tuthill
6,362,612 B1 * 3/2002 Harris ..... 323/312
6,373,330 B1 * 4/2002 Holloway ..... 327/539
6,885,224 B2 * 4/2005 Hastings ..... 327/78
2003/0137342 A1 7/2003 Opris
2005/0194957 A1 9/2005 Brokaw
2007/0013436 A1 1/2007 Chou

OTHER PUBLICATIONS

[Vijaya G. Ceekala], [A Method for Reducing the Effects of Random Mismatches in CMOS Bandgap References], [2002 IEEE International Solid-State Circuits Conference] , [Feb. 6, 2002].

[A. Paul Brokaw], [A Simple Three-Terminal IC Bandgap Reference], [Digest of Technical Papers] , [Feb. 15, 1974], [p. 188-189].

International application No. PCT/SG2010/000342, International filing date: Sep. 16, 2010, International Searching Report mailing date Jul. 11, 2011.

* cited by examiner

*Primary Examiner* — Adolf Berhane

(74) *Attorney, Agent, or Firm* — Winston Hsu; Scott Margo

(57) ABSTRACT

A voltage reference source is provided that includes a Brokaw bandgap core comprising a first set of transistors, a second set of transistors coupled to the first set of transistors and serving as load devices to the first set of transistors, and a dynamic element matching circuit coupled to the first and second sets of transistors so as to cancel the offset and noise produced by a selective number of the second set of transistors.

15 Claims, 4 Drawing Sheets

BANDGAP VOLTAGE REFERENCE WITH DYNAMIC ELEMENT MATCHING

BACKGROUND OF THE INVENTION

The invention is related to the field of electronic circuitry, and in particular to a bandgap voltage reference with dynamic element matching.

A Brokaw bandgap reference circuit is a voltage reference circuit widely used in integrated circuits, with an output voltage around 1.25 V with little temperature dependence. Like all temperature-independent bandgap references, the circuit maintains an internal voltage source having a positive temperature coefficient and another internal voltage source that has a negative temperature coefficient. By summing the two together, the temperature dependence can be canceled. Additionally, either of the two internal sources can be used as a temperature sensor.

The Brokaw bandgap reference circuit uses negative feedback (with an operational amplifier) to force an identical current through two bipolar transistors with different emitter areas. The transistor with the larger emitter area requires a smaller base-emitter voltage for the same current. The base-emitter voltage for either transistor has a negative temperature coefficient (i.e. value decreases with temperature). The difference between the two base-emitter voltages has a positive temperature coefficient (i.e. value increases with temperature).

To take full advantage of the low noise and high accuracy of the Brokaw circuit, an amplifier that uses both PNP and NPN type bipolar transistors is required. In a modern CMOS integrated circuit process, the NPN bipolar device can be fabricated, but not the PNP bipolar device. Therefore, there is a need to provide a low-noise, high-accuracy bandgap reference using the Brokaw core without using any PNP bipolar transistors. Furthermore, the reference should use as few current paths as possible, to minimize power consumption.

SUMMARY OF THE INVENTION

According to one aspect of the invention, there is provided a voltage reference source. The voltage reference source includes a Brokaw bandgap core comprising a first set of transistors. A second set of transistors is coupled to the first set of transistors. The second set of transistors serves as load devices to the first set of transistors. A dynamic element matching circuit is coupled to the first and second sets of transistors so as to cancel offset and noise produced by a selective number of the second set of transistors.

According to another aspect of the invention, there is provided a method of providing a reference voltage. The method includes arranging a first set of transistors in a Brokaw bandgap core arrangement. Also, the method includes selectively coupling a second set of transistors to the first set of transistors. The second set of transistors serves as load devices to the first set of transistors. The selectively coupling step decrease offset and noise produced by a selective number of the second set of transistors.

DETAILED DESCRIPTION OF THE INVENTION

The invention involves a bandgap voltage reference circuit based on the Brokaw bandgap reference circuit. This reference circuit can be implemented using PMOS transistors as the load devices. The technique of dynamic element matching is used to cancel the offset of these PMOS transistors.

Figure 1:
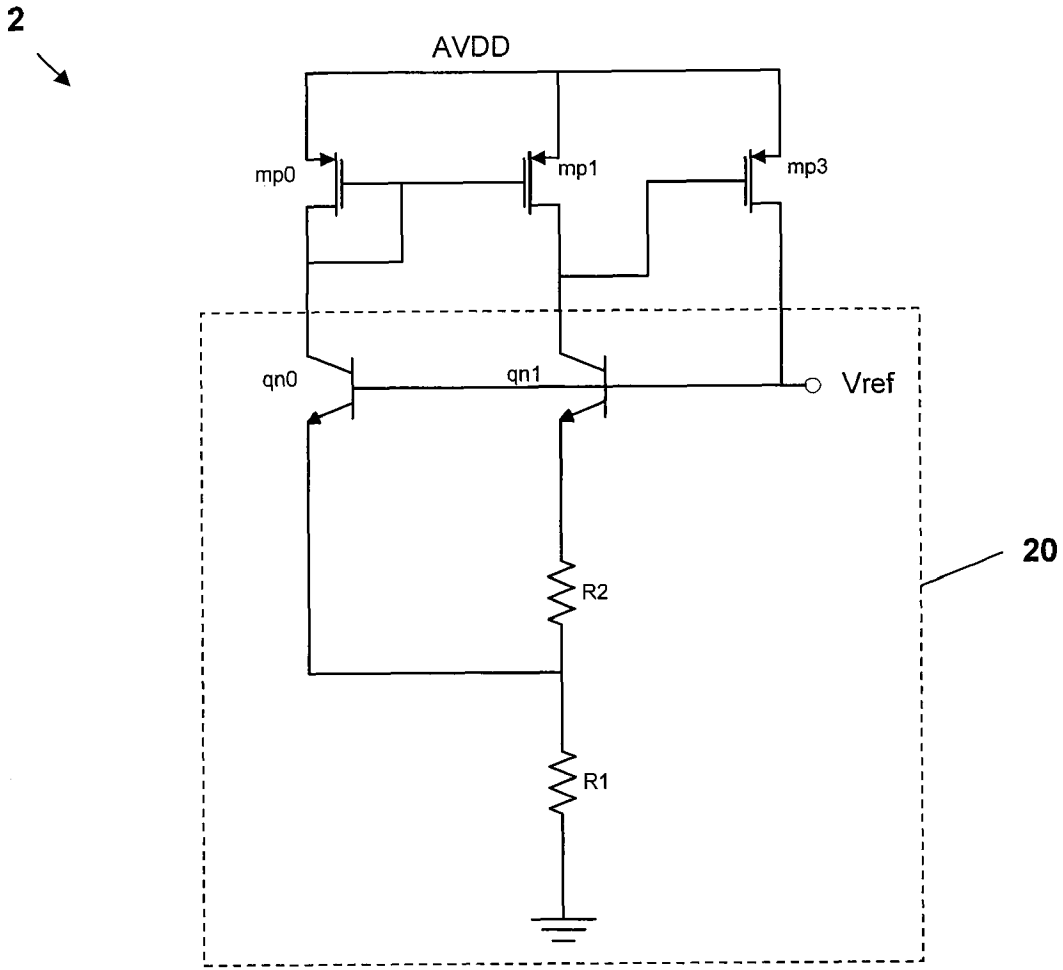
FIG. 1 is a circuit diagram illustrating a modified Brokaw bandgap reference circuit with PMOS active load and common-source amplifier in accordance with the invention.

FIG. 1 shows an exemplary embodiment of the bandgap voltage reference circuit 2 in accordance with the invention. The bandgap voltage reference circuit 2 includes a Brokaw bandgap core 20, where the Brokaw bandgap core 20 includes bipolar transistors qn0 and qn1 operated at different current densities, a resistive element (such as a resistor) R2 coupled between the emitters of the bipolar transistors qn0 and qn1, and a resistive element (such as a resistor) R1 coupled between the emitter of the bipolar transistor qn0 and ground. The bandgap voltage reference circuit 2 further includes a PMOS device mp0 having its gate and drain coupled to the collector of bipolar transistor qn0, a PMOS device mp1 having its gate coupled to the drain and gate of PMOS device mp0 and drain coupled to the collector of the bipolar transistor qn1, and a PMOS device mp3 having its gate coupled to the drain of PMOS mp1 and collector of bipolar transistor qn1. The bases of bipolar transistors qn0, qn1 and the drain of PMOS device mp3 are coupled to the voltage source Vref. The sources of PMOS devices mp0, mp1, mp3 are coupled to the voltage source AVDD. Please note the Brokaw bandgap core 20 shown in FIG. 1 is only an embodiment rather than a limitation; that is, other Brokaw bandgap structures can also be utilized and similar results can be achieved. For example, a resistive element may be added between the gates of the bipolar transistors qn0 and qn1.

The bandgap voltage reference circuit 2 provides the basis for a voltage reference. The conventional 8:1 ratio of emitter areas can be used due to the convenience of laying out this ratio in a common-centroid 3×3 array. Compared with the conventional Brokaw bandgap reference circuit which couples resistors to the collectors of bipolar transistors qn0 and qn1, the bandgap voltage reference circuit 2 using PMOS devices mp0 and mp1 as an active load uses no PNP bipolar transistors and fewer current paths. The PMOS device mp3 supplies the base currents to bipolar transistors qn0 and qn1, and can be regarded as a common-source stage providing enough gain and current drive to the core 20. The common-source stage may be sized to supply the base current if the gate voltages of transistors qn0 and qn1 are balanced under nominal conditions.

Figure 2:
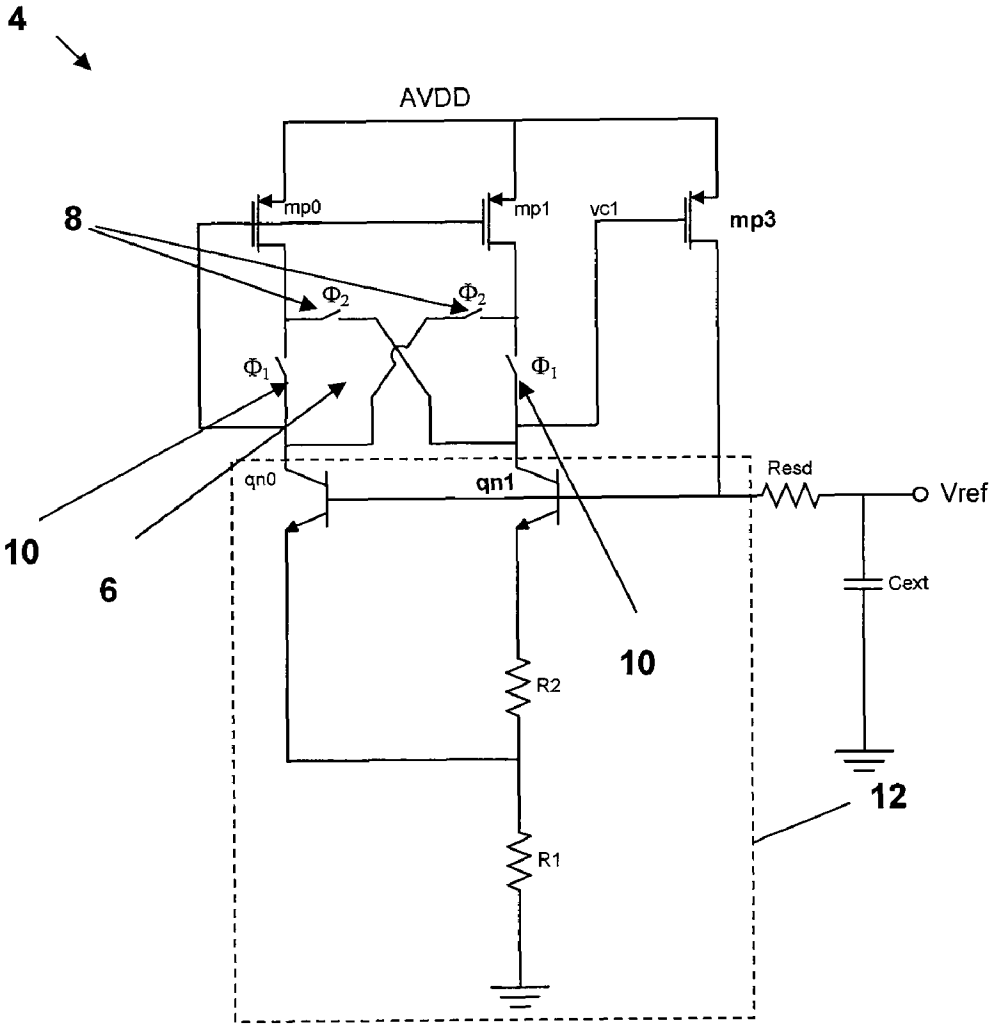
FIG. 2 is a circuit diagram illustrating another embodiment of the modified Brokaw bandgap reference circuit with PMOS active load and common-source amplifier and a dynamic element matching in accordance with the invention.

FIG. 2 shows another exemplary embodiment of a bandgap voltage reference circuit 4 where a dynamic element matching circuit 6 is used. The bandgap voltage reference circuit 4 includes a Brokaw bandgap core 12, a dynamic element matching circuit 6, and a load stage including PMOS devices mp0 and mp1. The PMOS device mp0 having its gate coupled to the collector of bipolar transistor qn0, and its drain selectively coupled to the collector of bipolar transistor qn0 or the collector of bipolar transistor qn1, depending on the operation of the dynamic element matching circuit 6. The gate of the PMOS device mp1 is coupled to the gate of PMOS device mp0. The drain of PMOS device mp1 is selectively coupled to the collector of bipolar transistor qn0 or the collector of bipolar transistor qn1, depending on the operation of the dynamic element matching circuit 6. The gate of a PMOS device mp3 is coupled to the collector of bipolar transistor qn1, providing gain and current drive to the core 12. The gates of bipolar transistors qn0, qn1 and the drain of PMOS device mp3 are coupled to the voltage source Vref and resistor Resd. The sources of PMOS devices mp0, mp1, mp3 are coupled to the voltage source AVDD. The emitter of bipolar transistor qn1 is coupled to one terminal of a resistor R2 and the emitter of bipolar transistor qn0 is coupled to resistor R1 and another terminal of the resister R2. The resistor R1 is coupled between the resistor R2 and ground. A capacitance element Cext is coupled to Vref and resistor Resd.

The dynamic element matching circuit 6 includes switches 8, 10. The switches 8 are controlled by a clock signal $\Phi_1$, and the switches 10 are controlled by another clock signal $\Phi_2$. The clock signals $\Phi_1$ and $\Phi_2$ are non-overlapped. When the switches 10 are closed by control signal $\Phi_1$, the switches 8 are open, and the bandgap voltage reference circuit 4 is similar to the structure 2 of FIG. 1 (the PMOS device mp0 is coupled to the bipolar transistor qn0, while the PMOS device mp1 is coupled to the bipolar transistor qn1). When the switches 10 are open and the switches 8 are closed by the clock signals, the drain of PMOS device mp0 is coupled to the collector of bipolar transistor qn1, and the drain of PMOS device mp1 is coupled to the collector of bipolar transistor qn0, i.e., the connection relationship between the PMOS devices and bipolar transistor devices are swapped.

The PMOS active load is retained with the addition of the dynamic element matching circuit 6 that nulls out the offset and 1/f noise of mp0 and mp1, as shown in FIG. 2. The dynamic element matching circuit 6 effectively swaps the position of mp0 and mp1 in the circuit topology once per clock cycle during phases $\Phi_1$ and $\Phi_2$. However, this is not meant to be a limitation; for example, the swapping cycles may be various and not exactly identical to one clock cycle of the clock signals $\Phi_1$ and $\Phi_2$. Since PMOS devices mp0 and mp1 operate under the same nominal Vgs, Vds and Id, the disturbance generated is minimal when the PMOS devices mp0 and mp1 are matched. If the PMOS devices mp0 and mp1 are mismatched, an AC current is injected onto the gate of PMOS device mp3. As will be shown, this bandgap voltage reference circuit 4 has two low-frequency poles (and one low-frequency zero). The AC current that results from PMOS offset is filtered once by the pole resulting from the capacitance at the gate of PMOS device mp3 and again by the pole resulting from the series combination of the resistor Resd and the capacitor Cext at the output of the bandgap voltage reference circuit 4. As a result, the upmixed spur from the offset undergoes second-order filtering. Choosing a relatively high modulation frequency can further ensure that this spur is filtered down to an insignificant level.

In other embodiments of the invention, other transistor elements besides PMOS and bipolar transistors can be used that exhibit similar properties without deviating from the basic concept of the invention.

Figures 3A, 3B, 3C:
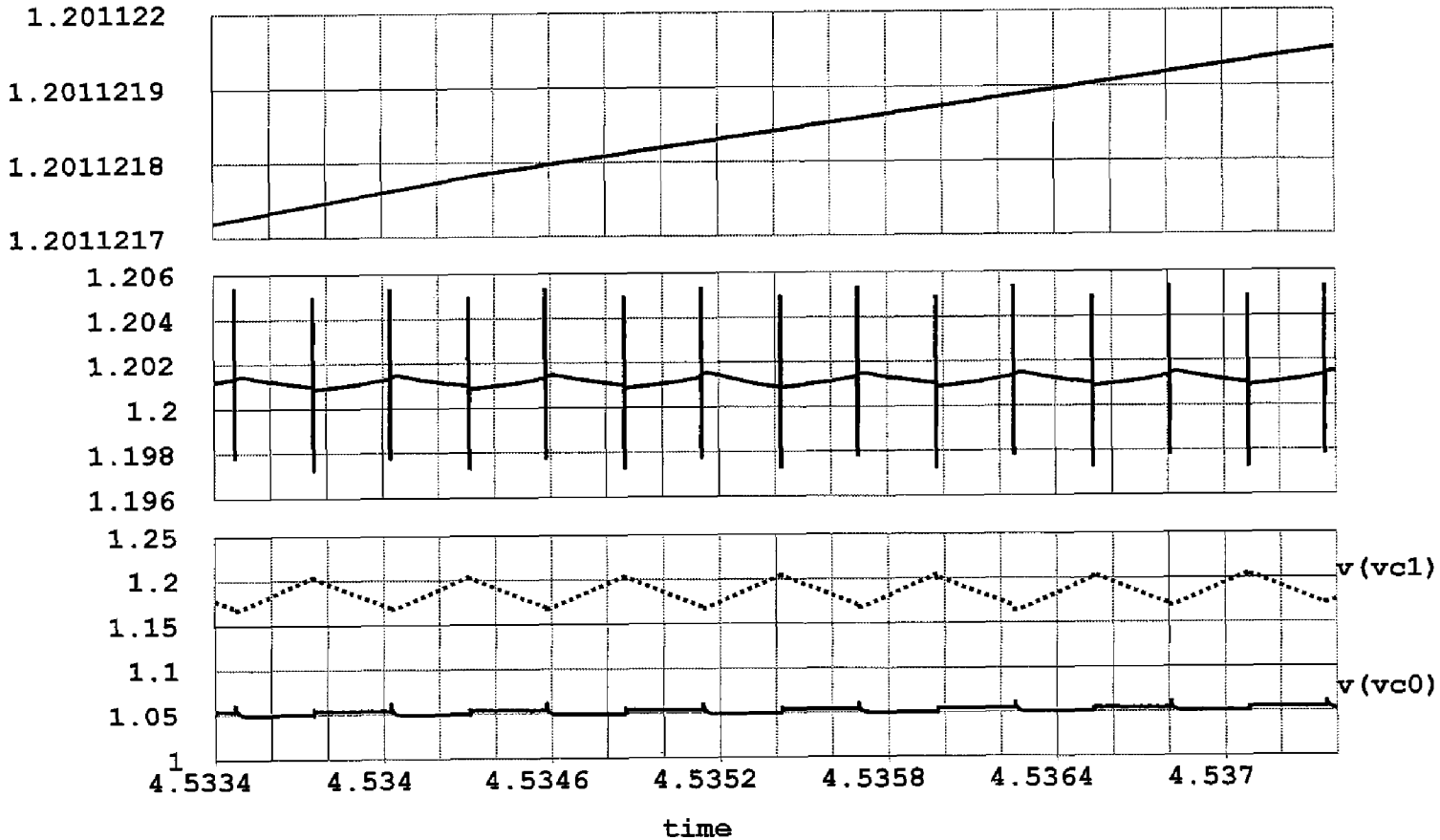
FIGS. 3A-3C are graphs illustrating the effect of the dynamic element matching.

FIG. 3A-3C illustrate the effects of dynamic element matching within the bandgap voltage reference circuit 4. A reference with a 5 mV offset between mp0 and mp1 is simulated, clocked at 1.8 MHz. FIG. 3A shows the output reference voltage Vref, which appears clean—at least the ripple is small compared to a 100 nV grid spacing. FIG. 3B shows the reference voltage measured internal to the Resd resistor. The effect of the dynamic element matching current through the PMOS device mp3 can be observed due to the voltage drop across the Resd resistor. FIG. 3C shows voltages at the collectors of qn0 (vc0) and qn1 (vc1). The voltage at vc0 is a square wave with an amplitude of 5 mV, reflecting the offset. The voltage at vc1 is a triangle wave, showing that the error current generated by dynamic element matching circuit 6 is integrated on the gate of mp3.

The dynamic element matching circuit 6 of FIG. 2 cancels the DC error due to PMOS offset to first order, and modulates the 1/f noise of the PMOS devices mp0 and mp1 to the modulation frequency in the same way that it upmixes offsets. Since noise at the modulation frequency is highly filtered, overall noise is reduced at low frequencies, and largely insignificant at frequencies over about 1 kHz.

Figure 4:
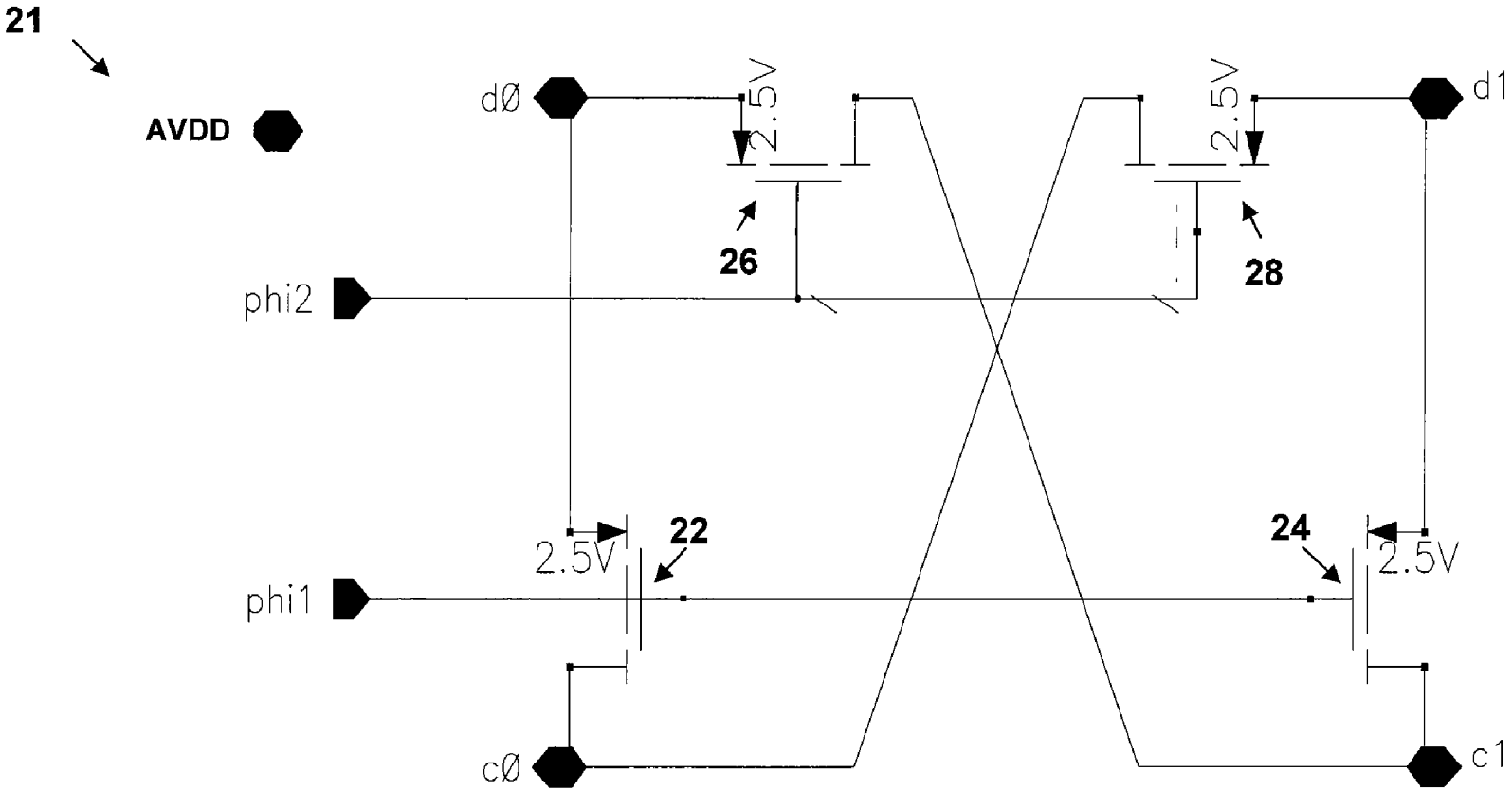
FIG. 4 is a circuit diagram illustrating an embodiment of the dynamic element matching circuit shown in FIG. 2 in accordance with the invention.

FIG. 4 describes an embodiment of the dynamic element matching circuit. The dynamic matching circuit 21 includes a PMOS device mp1 whose gate is coupled to the gate of PMOS device 24. The gates of PMOS devices 22 and 24 are coupled to a voltage source phi1 corresponding to the clock signal $\Phi_1$. The drains of PMOS devices 22 and 28 are coupled to node c0. The drains of PMOS devices 24 and 26 are coupled to node c1. The gates of PMOS devices 26 and 28 are coupled to a voltage source phi2 corresponding to the clock signal $\Phi_2$. The sources of PMOS devices 22 and 26 are coupled to node d0. The sources of PMOS devices 24 and 28 are coupled to node d1.

When the dynamic matching circuit 21 is implemented within the bandgap voltage reference circuit 4, for example, the collector of bipolar transistor qn0 is coupled to the node c0, the collector of bipolar transistor qn1 is coupled to the node c1, the drain of the PMOS device mp0 is coupled to the node d0, and the drain of the PMOS device mp1 is coupled to the node d1. In this way, the connection relationship between the PMOS devices mp0 and mp1 and the bipolar transistors qn0 and qn1 are swapped during the first phase and the second phase. This configuration decreases or removes DC error due to PMOS offset to first order, and modulates the 1/f noise of the PMOS devices mp0 and mp1.

Although the present invention has been shown and described with respect to several preferred embodiments thereof, various changes, omissions and additions to the form and detail thereof, may be made therein, without departing from the spirit and scope of the invention.

What is claimed is:

1. A voltage reference source comprising:

a Brokaw bandgap core comprising a first set of transistors;

a second set of transistors coupled to said first set of transistors, said second set of transistors serving as load devices to said first set of transistors; and a dynamic element matching circuit coupled to said first and second sets of transistors so as to cancel offset or noise produced by a selective number of said second set of transistors.

2. The voltage reference source of claim 1, wherein said first set of transistors comprise bipolar transistors.

3. The voltage reference source of claim 1, wherein said second set of transistors comprising PMOS transistors.

4. The voltage reference source of claim 1, wherein said dynamic element matching circuit swaps connection relationship between the selective number of transistors and the first set of transistors.

5. The voltage reference source of claim 4, wherein said dynamic element matching circuit is controlled by at least one clock signal, and the dynamic element matching circuit swaps the connection once per clock cycle of the clock signal.

6. The voltage reference source of claim 4, wherein said dynamic element matching circuit comprises two phases, wherein in a first phase, said dynamic element matching circuit couples a first transistor in the first set of transistors to a first transistor of the second set of transistors and couples a second transistor in the first set of transistors to a second transistor of the second set of transistors, and in a second phase, said dynamic element matching circuit couples the first transistor in the first set of transistors to the second transistor of the second set of transistors and couples the second transistor in the first set of transistors to the first transistor of the second set of transistors.

7. The voltage reference source of claim 4, wherein said dynamic element matching circuit comprises a plurality of switching elements.

8. The voltage reference source of claim 1, further comprising a common source stage, coupled to the Brokaw bandgap core, for providing gain and current drive to the Brokaw bandgap core.

9. The voltage reference source of claim 8, wherein the common source stage comprises a transistor having a gate coupled to the said first set of transistors, a source coupled to the second set of transistors, and a drain coupled to an output of the voltage reference source.

10. The voltage reference source of claim 1, further comprising a resistive element and a capacitive element forming a pole at an output of the voltage reference source.

11. A method of providing a reference voltage comprising arranging a first set of transistors in a Brokaw bandgap core arrangement; and selectively coupling a second set of transistors to said first set of transistors, said second set of transistors serving as load devices to said first set of transistors;

wherein the selectively coupling step is utilized to cancel offset and noise produced by a selective number of said second set of transistors.

12. The method of claim 11, wherein said selectively coupling step comprises swapping connection relationship between the selective number of transistors and the first set of transistors.

13. The method of claim 12, wherein said selectively coupling step comprises two phases, wherein in a first phase, a first transistor in the first set of transistors is coupled to a first transistor of the second set of transistors and a second transistor in the first set of transistors is coupled to a second transistor of the second set of transistors, and in a second phase, the first transistor in the first set of transistors is coupled to the second transistor of the second set of transistors and the second transistor in the first set of transistors is coupled to the first transistor of the second set of transistors.

14. The method of claim 11, further comprising arranging a common source stage for providing gain and current drive to the Brokaw bandgap core.

15. The method of claim 11, further comprising arranging a pole at an output of the Brokaw bandgap core.

* * * * *